US008240091B2

(12) United States Patent
Cittadini et al.

(10) Patent No.: US 8,240,091 B2
(45) Date of Patent: Aug. 14, 2012

(54) DOUBLE-SEAL GASKET FOR REFRIGERATOR CABINETS WITH HIGH HEAT INSULATION PROPERTIES

(75) Inventors: Paolo Cittadini, Luvinate (IT); Marco De Giorgi, Varese (IT)

(73) Assignee: Industrie Ilpea S.p.A., Malgesso-Varese (IT)

( * ) Notice: Subject to any disclaimer, the term of this patent is extended or adjusted under 35 U.S.C. 154(b) by 631 days.

(21) Appl. No.: 11/887,094

(22) PCT Filed: Mar. 20, 2006

(86) PCT No.: PCT/EP2006/060876

§ 371 (c)(1),
(2), (4) Date: Sep. 20, 2007

(87) PCT Pub. No.: WO2006/100220

PCT Pub. Date: Sep. 28, 2006

(65) Prior Publication Data

US 2009/0058246 A1 Mar. 5, 2009

(30) Foreign Application Priority Data

Mar. 21, 2005 (IT) ..... M12005A0455

(51) Int. Cl.
*E06B 7/16* (2006.01)

(52) U.S. Cl. ..... 49/495.1; 49/475.1; 49/478.1; 49/489.1; 49/493.1; 49/498.1

(58) Field of Classification Search ..... 49/475.1, 49/478.1, 489.1, 493.1, 495.1, 498.1; 312/296, 312/405

See application file for complete search history.

(56) References Cited

U.S. PATENT DOCUMENTS 2,963,754 A 12/1960 Herman
3,078,134 A * 2/1963 Haynes, Jr. ..... 312/296
5,117,587 A 6/1992 Doan (Continued)

FOREIGN PATENT DOCUMENTS

EP 0146994 7/1985

(Continued)

OTHER PUBLICATIONS

International Search Report and Written Opinion mailed on Jul. 20, 2006 by the European Patent Office in counterpart foreign application No. PCT/EP2006/060876.

(Continued)

*Primary Examiner* — Shane Bomar
*Assistant Examiner* — Robert E Fuller
(74) *Attorney, Agent, or Firm* — Abelman, Frayne & Schwab

(57) ABSTRACT

Gasket for refrigerator cabinets of the kind including a soft bellows-type portion used for sealing the area between the cabinet and the door and extending from a base portion able to match the outer door and/or inner door of the refrigerator cabinet. The base portion is substantially rigid and has at one end, a sealing portion made of substantially soft material extending toward the inner door. The soft material portion has good flexible and spring back features when exposed to refrigerator and freezer temperatures. These features make the gasket able to further seal, preferably by compression, the space located between the cabinet and inner door in a more internal area of the refrigerator cabinet. Furthermore, the soft sealing portion is independent and free from constraints with respect to the soft bellows-type portion.

23 Claims, 10 Drawing Sheets

U.S. PATENT DOCUMENTS

| | | | | |
|---|---|---|---|---|
| 5,297,360 | A * | 3/1994 | Besore et al. | 49/484.1 |
| 5,533,311 | A | 7/1996 | Tirrell et al. | |
| 5,551,192 | A * | 9/1996 | Avendano et al. | 49/484.1 |
| 5,560,694 | A * | 10/1996 | Banicevic et al. | 312/405 |
| 5,915,805 | A * | 6/1999 | Lee | 312/405 |
| 5,950,366 | A * | 9/1999 | Uhlmeyer | 49/484.1 |
| 6,058,657 | A | 5/2000 | Merla | |
| 6,543,785 | B1 | 4/2003 | Katayama et al. | |
| 6,804,915 | B2 | 10/2004 | Holmqvist | |
| 7,080,485 | B2 * | 7/2006 | Cittadini | 49/478.1 |
| 7,147,292 | B2 * | 12/2006 | Lee et al. | 312/296 |
| 7,219,471 | B2 | 5/2007 | Cittadini et al. | |
| 2004/0094468 | A1 * | 5/2004 | Fritze | 210/349 |
| 2007/0084125 | A1 * | 4/2007 | Gholap et al. | 49/478.1 |

FOREIGN PATENT DOCUMENTS

| | | | |
|---|---|---|---|
| EP | 0319087 | | 6/1989 |
| EP | 0905464 | | 3/1999 |
| EP | 1267136 | | 12/2002 |
| FR | 65396 | | 2/1956 |
| JP | 50107556 | | 8/1975 |
| JP | 01918815 | | 6/1989 |
| JP | 08-121947 | | 5/1996 |
| JP | 10-111071 | | 4/1998 |
| JP | 10259983 | | 9/1998 |
| JP | 11-1599474 | | 1/1999 |
| JP | 2001-1505953 | | 6/2001 |
| JP | 2002-022349 | A | 1/2002 |
| JP | 2003-004370 | | 1/2003 |
| JP | 2004132684 | | 4/2004 |
| WO | WO00/28267 | | 5/2000 |
| WO | WO02/066912 | | 8/2002 |
| WO | WO 02/070971 | A1 | 9/2002 |
| WO | WO03/048662 | | 6/2003 |
| WO | WO2006/079650 | | 8/2006 |

OTHER PUBLICATIONS

International Preliminary Report on Patentability, completed Jun. 28, 2007, by the European Patent Office in counterpart foreign application no. PCT/EP2006/060876.

* cited by examiner

DOUBLE-SEAL GASKET FOR REFRIGERATOR CABINETS WITH HIGH HEAT INSULATION PROPERTIES

CROSS-REFERENCE TO RELATED APPLICATIONS

This application is a 371 of PCT/EP2006/060876, filed Mar. 20, 2006, which claims priority to Italian Application No. MI2005A000455, filed Mar. 21, 2005, the contents of each said applications being incorporated by reference herein and made a part of this application.

FIELD OF THE INVENTION

The present invention relates to a gasket for refrigerator cabinets of the type including a soft bellows-type portion for sealing the area between a cabinet and a door, as well as a base portion able to fit the outer door and/or inner door of the refrigerator cabinet, wherein the shell is defined by the outer door and inner door filled with thermal-insulation material.

PRIOR ART

Gaskets of such kind are, for instance, described in EP 146994, EP 319087 and EP 1129319 of the Applicant hereof. For instance, with reference to the latter, a known gasket able to seal the area between the outer door 30 and the cabinet 17 of a refrigerator is of the type represented in FIG. 1 of the attached drawings, comprising a soft bellows-type sealing portion ending with an expanding section with a magnetic profile connected to a base provided with a securing foot which is placed inside a special socket of the inner door 31. The heat insulation in this type of gasket, currently used in refrigerators, is achieved both through the contact of the magnetic profile of the gasket along the whole perimeter of the refrigerator cabinet 17 and through the tubular chamber, or balloon (also part of the bellows), with the inner door 31 and cabinet 17.

However, especially with combined freezers or refrigerators which operate at temperatures lower than 0° C., known gaskets of the type described in FIG. 1 have serious drawbacks inasmuch as the operation of the bellows is altered by the loss of flexibility of its plastic structure, normally plasticized PVC, due to the air at low temperature (which may drop to about −25° C.) which comes directly into contact with the gasket through the space 4 located between said cabinet and the inner door in the area next to the gasket, as shown in FIG. 1.

Moreover, the possible non-levelness of the refrigerator cabinet zone in which the magnetic part of the gasket seals can cause losses of energy and formations of ice in case there is no contact between the gasket and the cabinet thereof.

SUMMARY OF THE INVENTION

Compared to such known sealing systems, the present invention intends to considerably improve the thermal efficiency of the refrigerating appliance, by reducing its consumption of energy and the formation of ice inside of it, by drastically reducing the heat transmission between the outside and the inside cold part which may occur around the entire sealing perimeter between the door and the cabinet. The purpose of the invention is also to maintain an ideal functionality of the main sealing element of the gasket, i.e. the extendible bellows, allowing it to operate at higher temperatures compared to those of the refrigerator.

In order to achieve such aims, as well as other advantages which will be described in the following, the present invention provides a gasket for refrigerator cabinets of the type including a soft bellows-type portion for sealing the area between the cabinet and the door, extending from a base portion able to match the outer door and/or inner door of the refrigerator cabinet, wherein said base portion is substantially rigid and at one end of it which faces the said inner door 31 a means made of substantially soft material extends to seal the space located between said cabinet and inner door, wherein said sealing means is independent and free from constraints with respect to said soft bellows-type portion.

In the gasket according to the invention, said soft bellows-type portion, which functions preferably, but not necessarily, in expansion by magnetic pull, allows the door to close so as to compress said means substantially made of soft material, thereby sealing the space located between said cabinet and inner door.

In order to better understand the features and advantages of the invention, non limiting examples of practical embodiments will be described hereinafter with reference to the figures in the attached drawings. It is clarified that in these drawings the gasket of the invention is, non-limitatively, of the magnetic type and is shown in an operating position working together with the cabinet, the outer door and the inner door of the refrigerator.

DETAILED DESCRIPTION OF THE INVENTION

Figure 1:
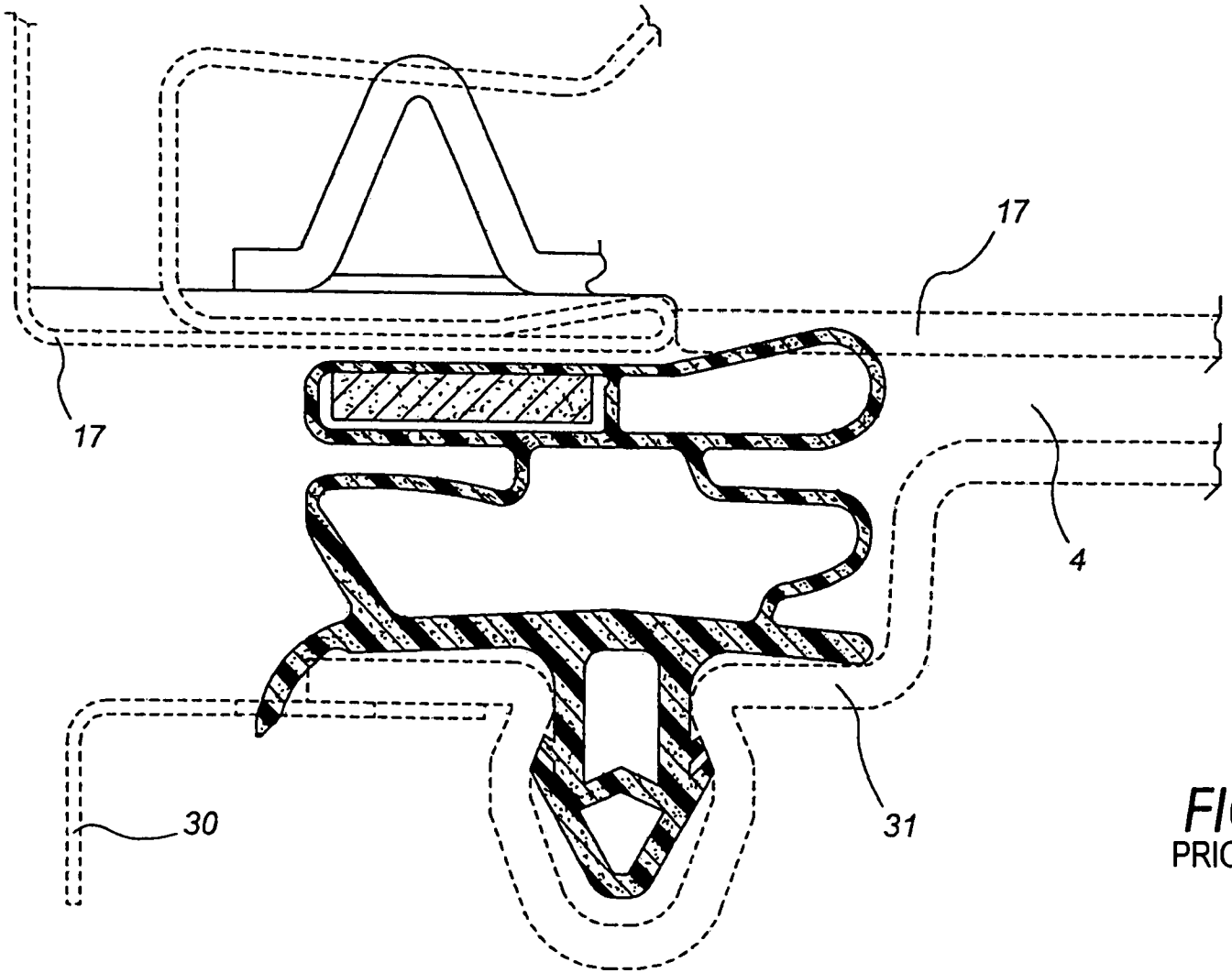
FIG. 1 PRIOR ART
FIG. 1 as mentioned above, applies to the prior art.

With reference to such drawings, the gasket 10 of the invention includes a soft bellows portion 11, e.g. plasticized PVC or the like, coextruded with a base portion 12 made from, for instance, rigid PVC. The bellows portion 11 is preferably of the magnetic type, ending at the top with a recess 8 able to contain a strip or section made of magnetic material. In all the previously described embodiments, with the exception of the one in FIG. 9, in said bellows portion 11 from said recess 8, there is a tubular, or balloon 7, compression sealing chamber placed beside and towards the inner door 31. In the embodiments (FIGS. 1, 2, 3, 4, 5), said base portion 12 of the gasket 10 has U-inverted shaped section as described in commonly assigned Italian Patent Application No. MI2005A000121 (and WIPO publication no. WO 2006/079650), both of which are incorporated herein by reference. Such section is defined by a horizontal section 13 and a couple of vertical sections, one of which is operationally external 16 for matching the outer door 30, a folded sheet metal ending with a plane surface 9, whereas the other is operationally internal 19 for matching the inner door 31. To this purpose, said section 16 ends with one foot 20 used for matching the plane surface 9 on the outer door 30, whereas said section 19 ends with one foot 21, from which a vertical section 22 extends inwardly with a securing snap-lock means 23, by interposition of a soft elbow 24, with the end of the inner door 31, e.g. as described in commonly assigned European Patent Nos. EP 146994 and EP 319087.

In the gasket 10 the soft material of portion 11 is coextruded with the rigid material of portion 12 along the entire length of the section 16 and ends with a lip 25 which is suitable for operationally sealing the plane surface 9 of the outer door 30 so as to prevent leaking of thermal-insulation material, for instance polyurethane foam, in the final filling phase of the door shell. For such sealing purposes, additional soft coextruded lips are required, i.e. 27 on said securing means 23 and 28 on the said foot 21 of the base of the gasket. In the embodiment shown in FIG. 7, the gasket 10 has a base portion 12 substantially consisting of a T section in which a vertical section 32, ending with lips 33 made from coextruded soft material, extends towards the inner door from a horizontal section 13. Such structure consists of a securing means for the inner door 31, which is specifically made in the shape of a hollow socket 34 to house the vertical section 32 and to firmly match it due to the action of the soft lips 33 which bend, thereby firmly sealing the walls of said hollow socket 34. Even in such embodiment, in the gasket 10, the soft material of portion 11 is coextruded with the rigid material of portion 12 along the entire length of the section 16 and ends with a lip 25 which is suitable for operationally sealing the plane surface 9 of the outer door 30 so as to prevent leaking of thermal-insulation material in the final filling phase of the door shell.

Figure 8:
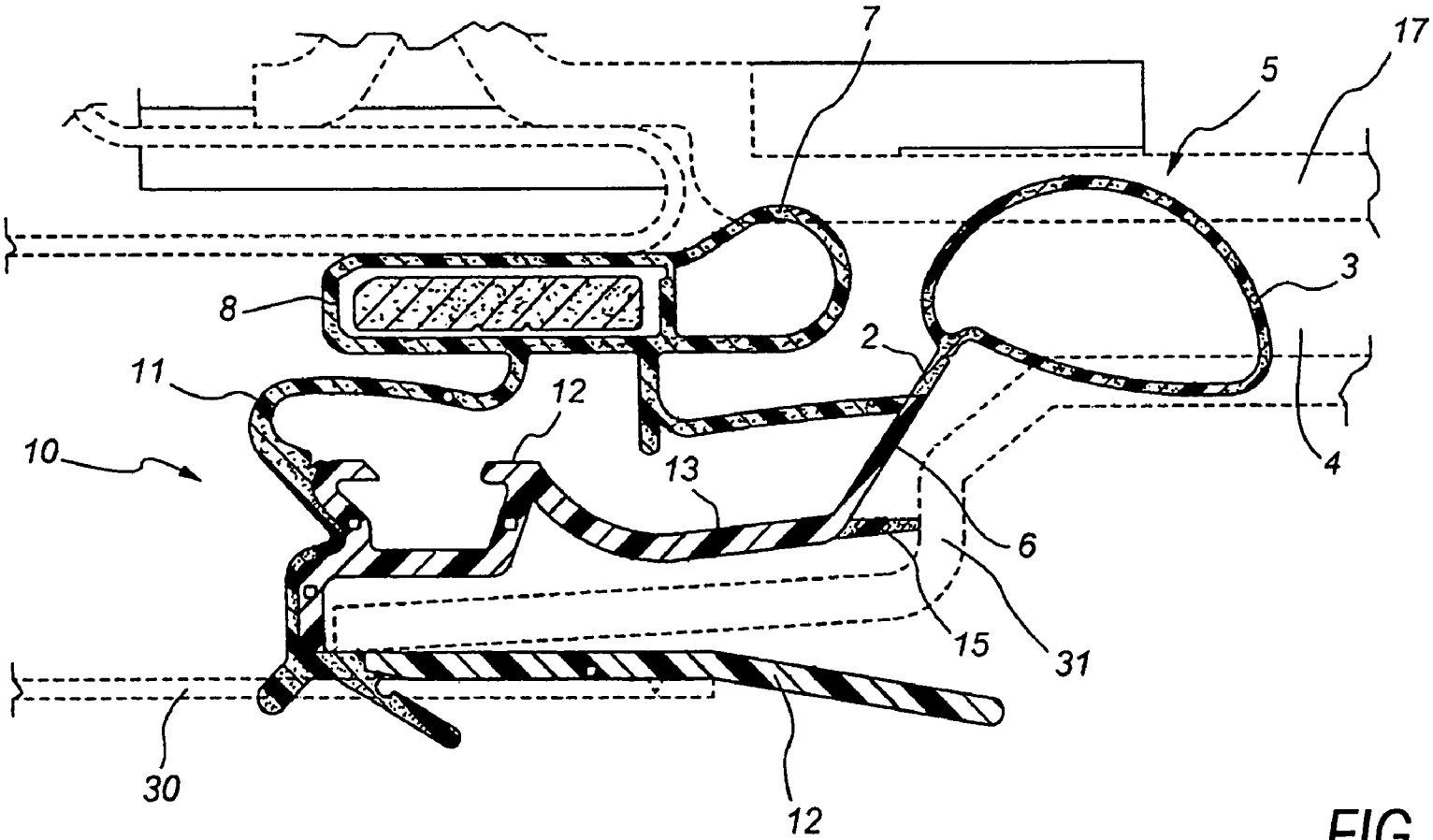

In the embodiment shown in FIG. 8, the gasket 10 according to the invention is provided with a rigid base 12, coextruded with a soft bellows-type portion 11 of the type described in commonly assigned European Patent No. EP0905464 and PCT/EP02/00668 (corresponding to WIPO publication no. WO2002/066912), which are incorporated by reference herein. The rigid base is substantially a C-section which can be splayed out and is able to fit the inner door in automated assembly systems.

Figure 9:
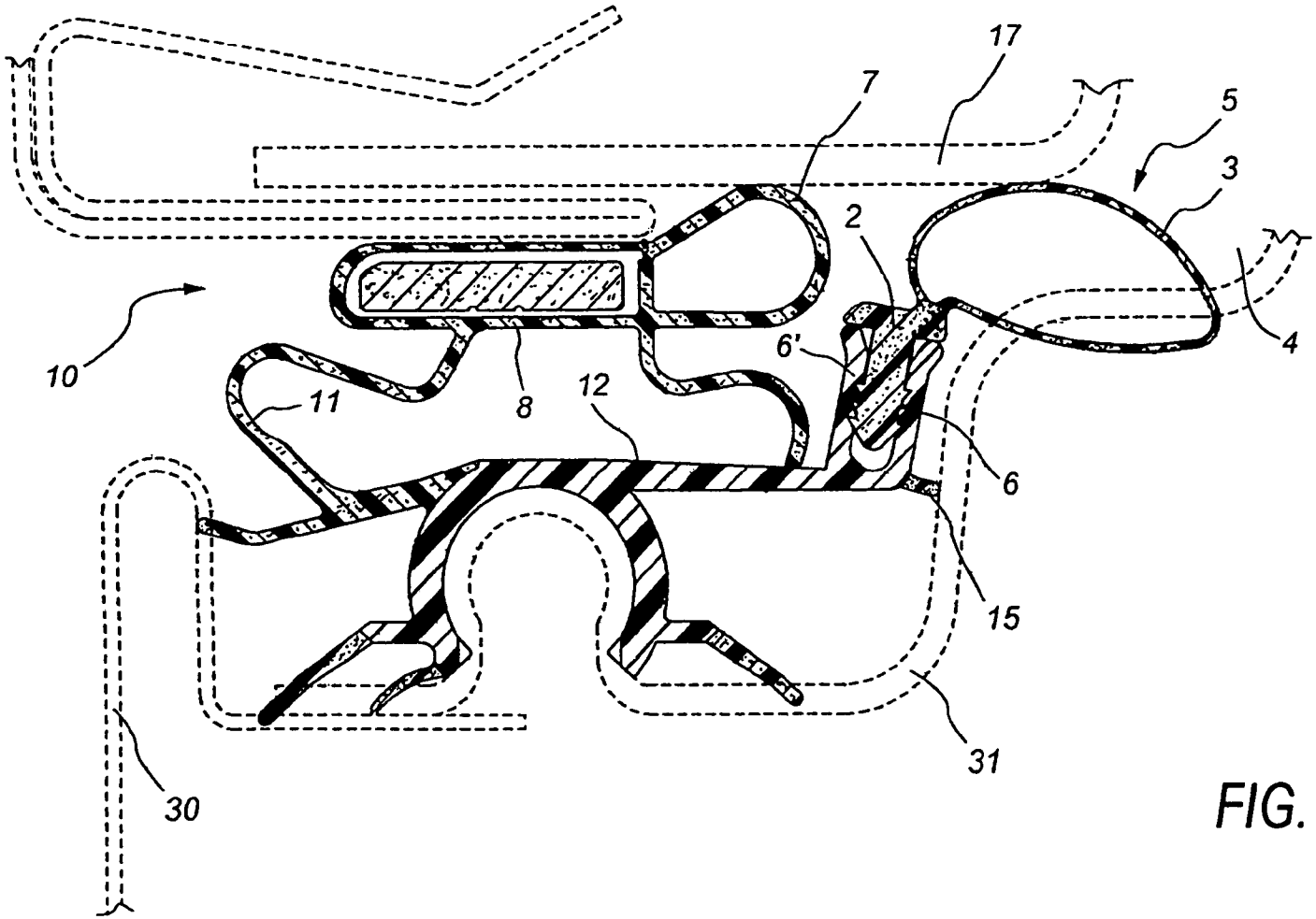

In the embodiment shown in FIG. 9, the gasket 10 according to the invention is provided with a rigid base 12, coextruded with a soft bellows-type portion 11 as described in commonly assigned International patent Application No. PCT/EP02/10606 (corresponding to WIPO publication no. WO2003/048662), which are incorporated by reference herein. It is substantially a rigid base with a female Omega section complementary to a similar male section obtained on the inner door for compression and interference fit.

Figure 7:
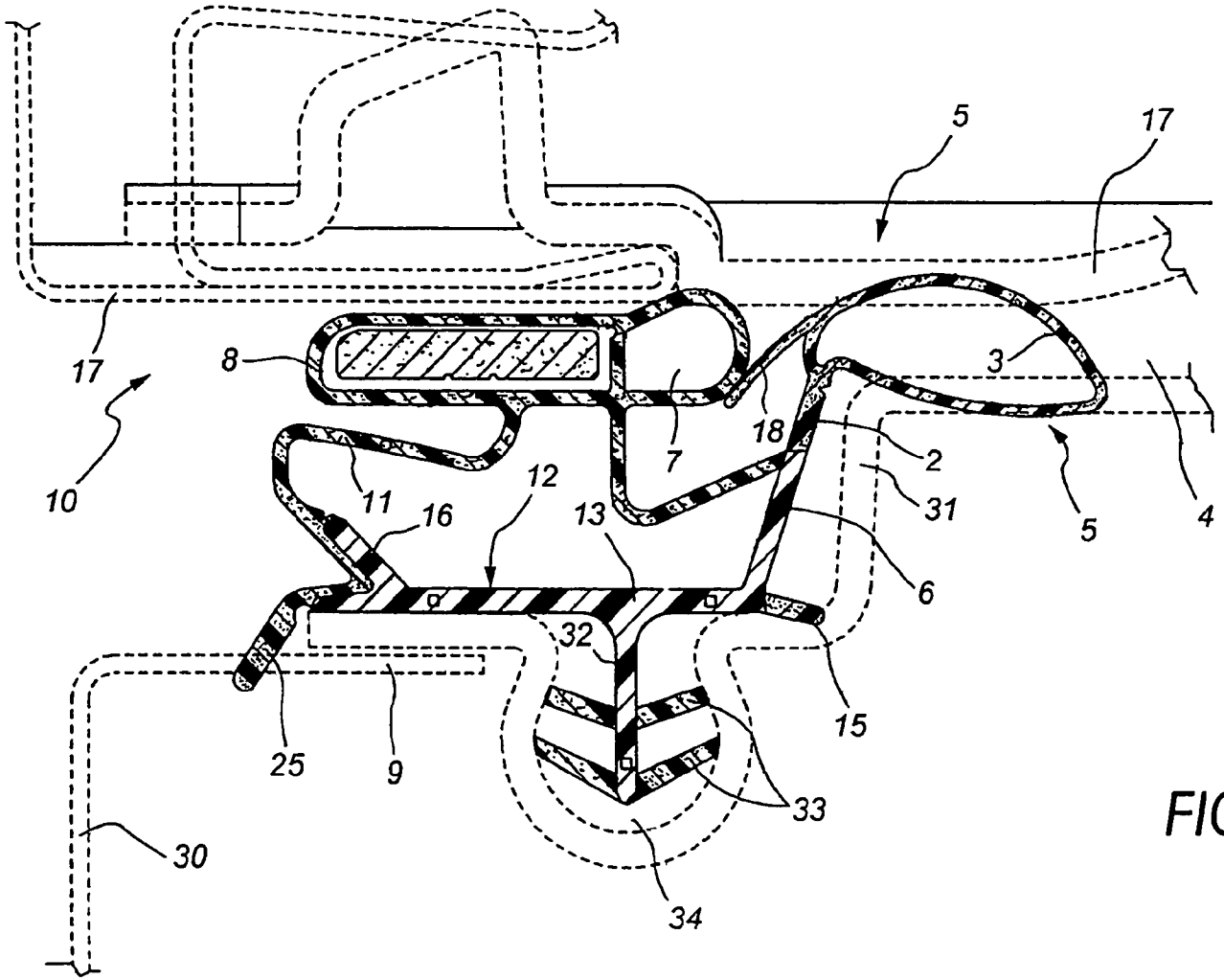
Figure 10:
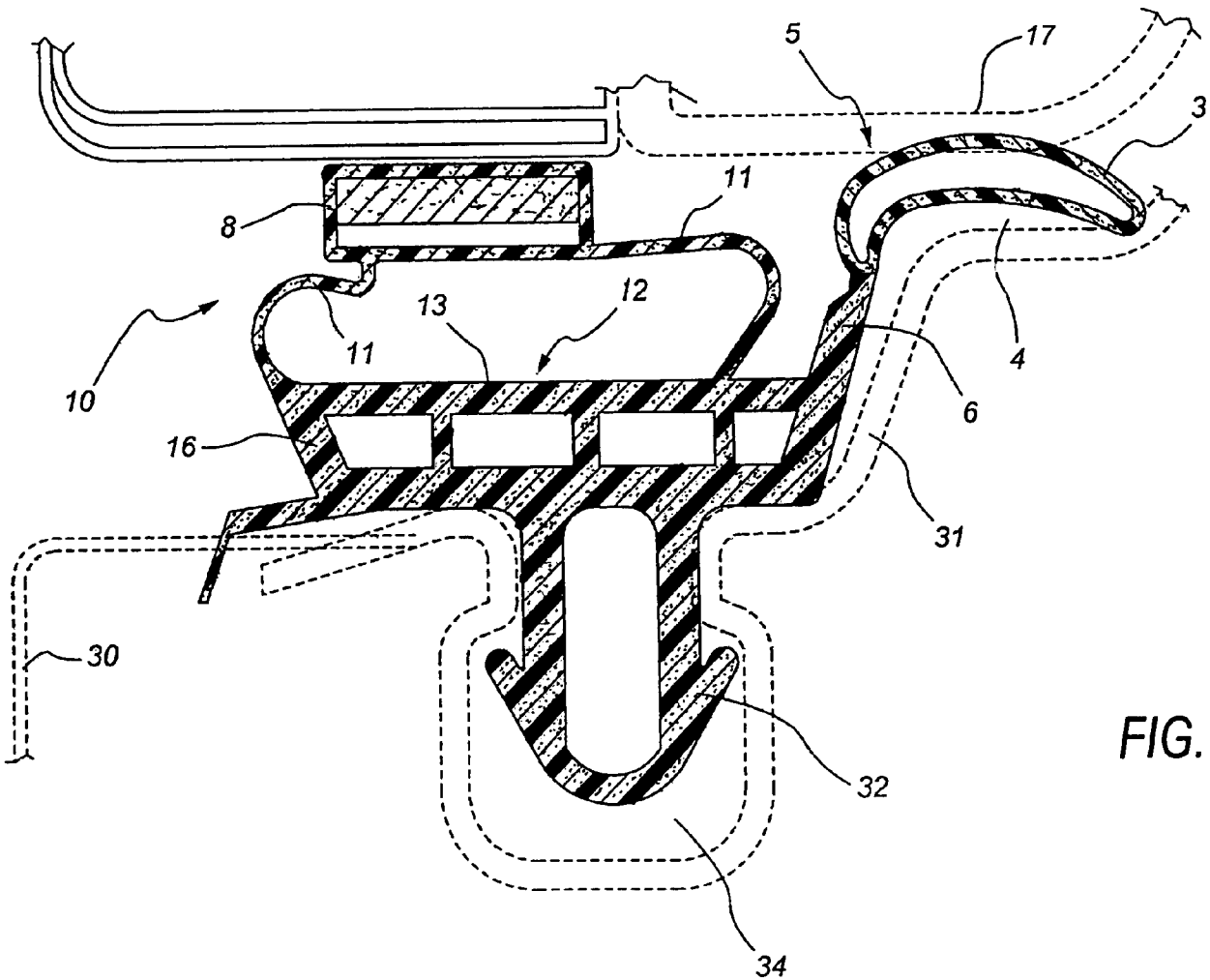
FIG. 10 shows a cross-section view of an embodiment according to the invention, of a monoextruded gasket, that is extruded in one material.

In the embodiment shown in FIG. 10, the gasket 10 according to the invention is structurally similar to the one in FIG. 7, provided with a securing means for the inner door 31 specifically made in the shape of a hollow socket 34 to house the vertical section 32, but achieved here by extrusion in one soft material (hence monoextruded), of the type used for the bellows portion 11, thus suitably increasing the thickness of the base portion 12 so that the latter can obtain enough stiffness due to the oversized thickness both on the vertical sections 16 and 6 and on the horizontal section 13.

According to the present invention, regardless of the specific embodiment, said rigid base portion 12—at the end of the horizontal section 13, operationally facing said inner door 31—curves vertically or obliquely according to a section 6 which substantially follows the inner door profile, where there is a means 5 made of substantially soft material capable of sealing the space 4 located between said cabinet 17 and inner door 31, said sealing means being independent and free from constraints with respect to said soft bellows-type portion 11, as better specified hereinafter with the description of each single embodiment.

In the area in which the rigid base 12 is shaped according to said section 6, there is a lip 15 made of soft material used as an additional sealing means, which operationally extends toward the inner door 31 helping the positioning of the gasket or, optionally, to contain the polyurethane foam in case it has passed through the chamber located below it.

Figure 2:
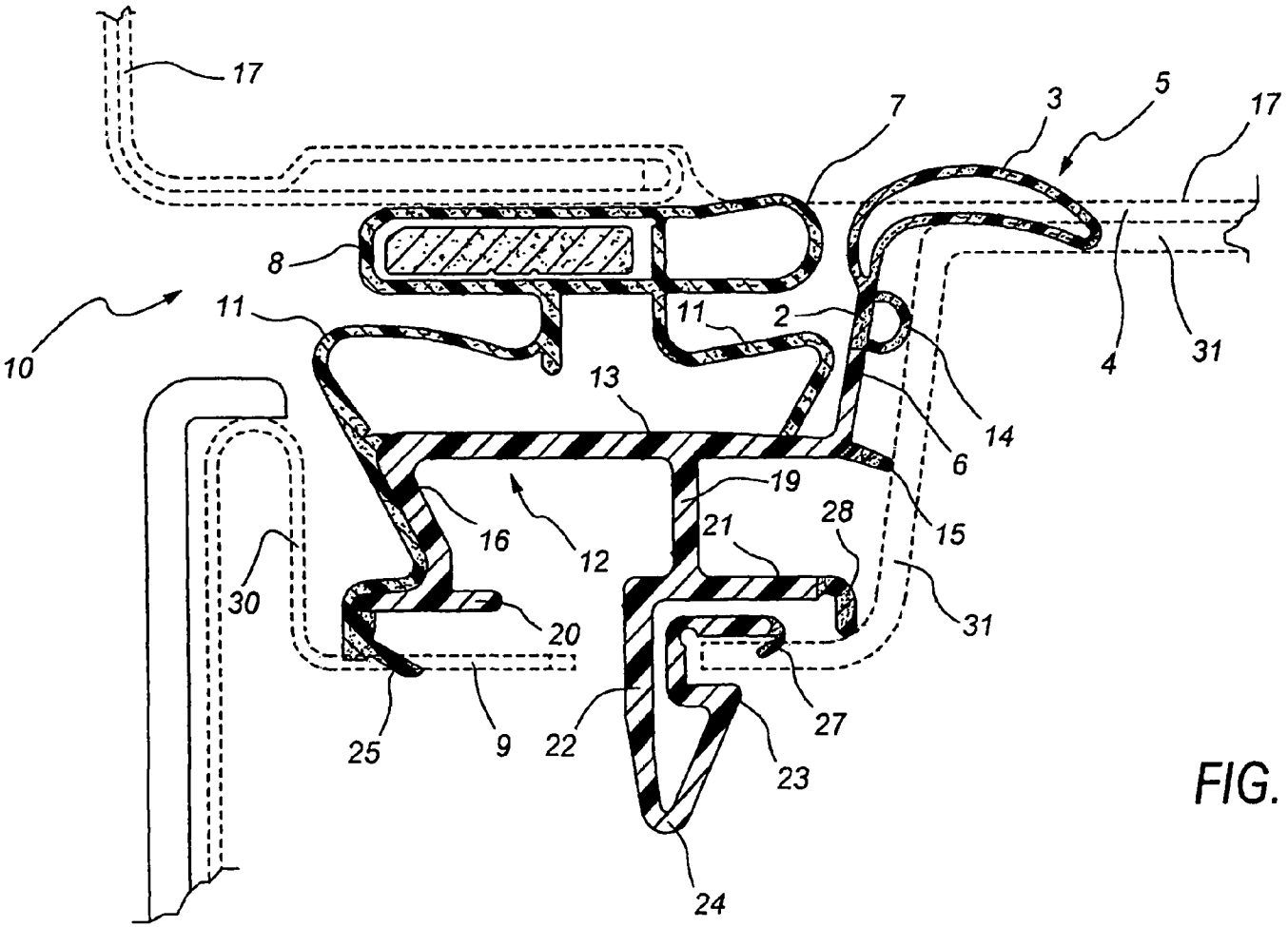
FIG. 2 shows a cross-section view of a gasket according to the invention.

In the embodiment shown in FIG. 2, the sealing means 5 is coextruded in soft material with respect to said section 6 of said base 12 and comprises an extending section 2 of said rigid section 6 where there is a tubular chamber, or balloon, 3 with a lengthened section substantially complementary to that of the said space 4 so as to seal such space, by deforming through squashing on the edge of the cabinet 17 when the door, and inner door 31, is closed. The sealing means 5 is completed by a tubular sealing element 14 which extends from said section 2 towards the inner door.

Figure 3:
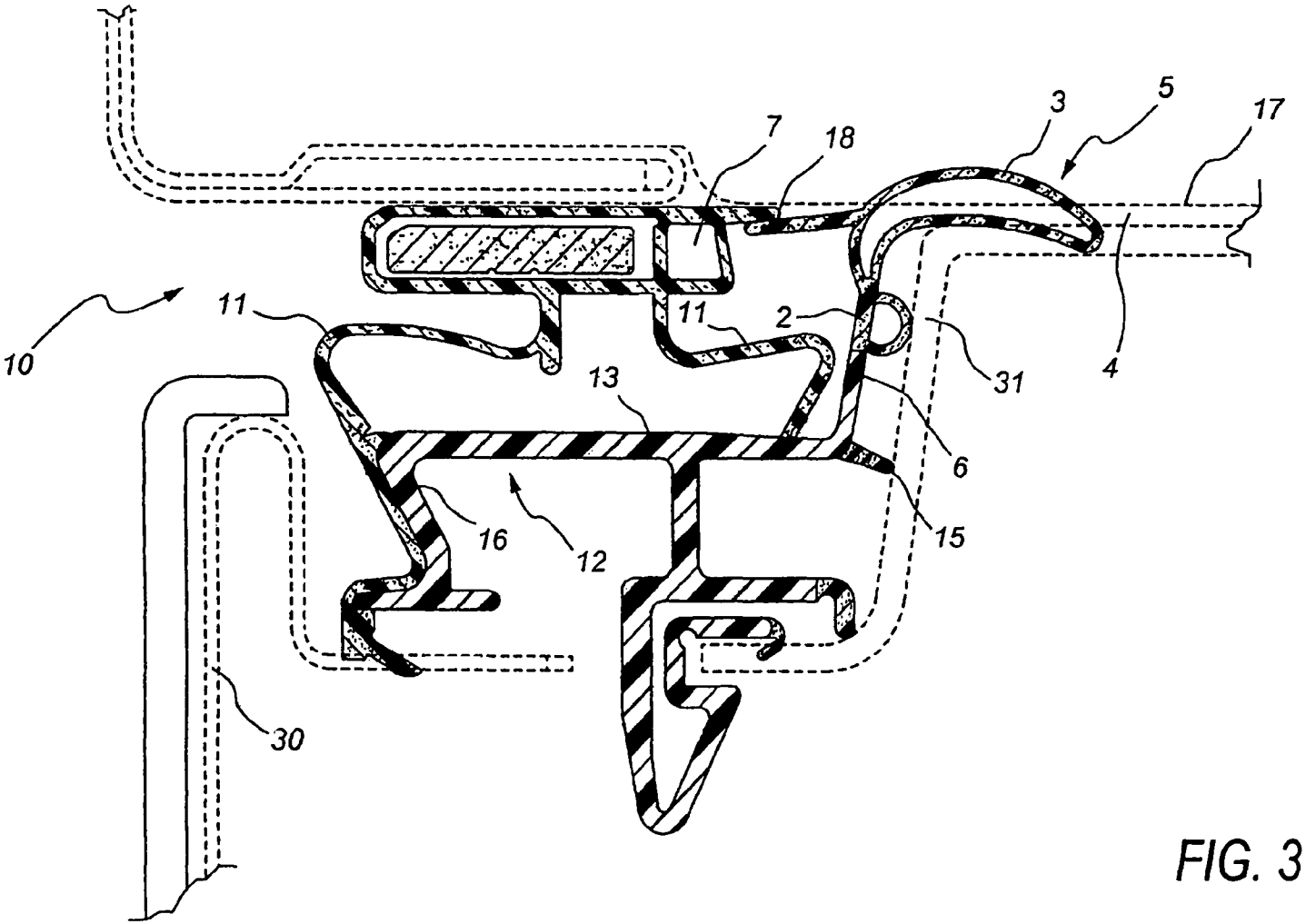
FIGS. 3-9 show a similar cross-section of a corresponding number of embodiments of the gasket according to the invention.

In the embodiment shown in FIG. 3, the sealing means 5 differs from the previous embodiment due to the presence of a sealing lip 18 which operationally extends towards the bellows 11.

Figure 4:
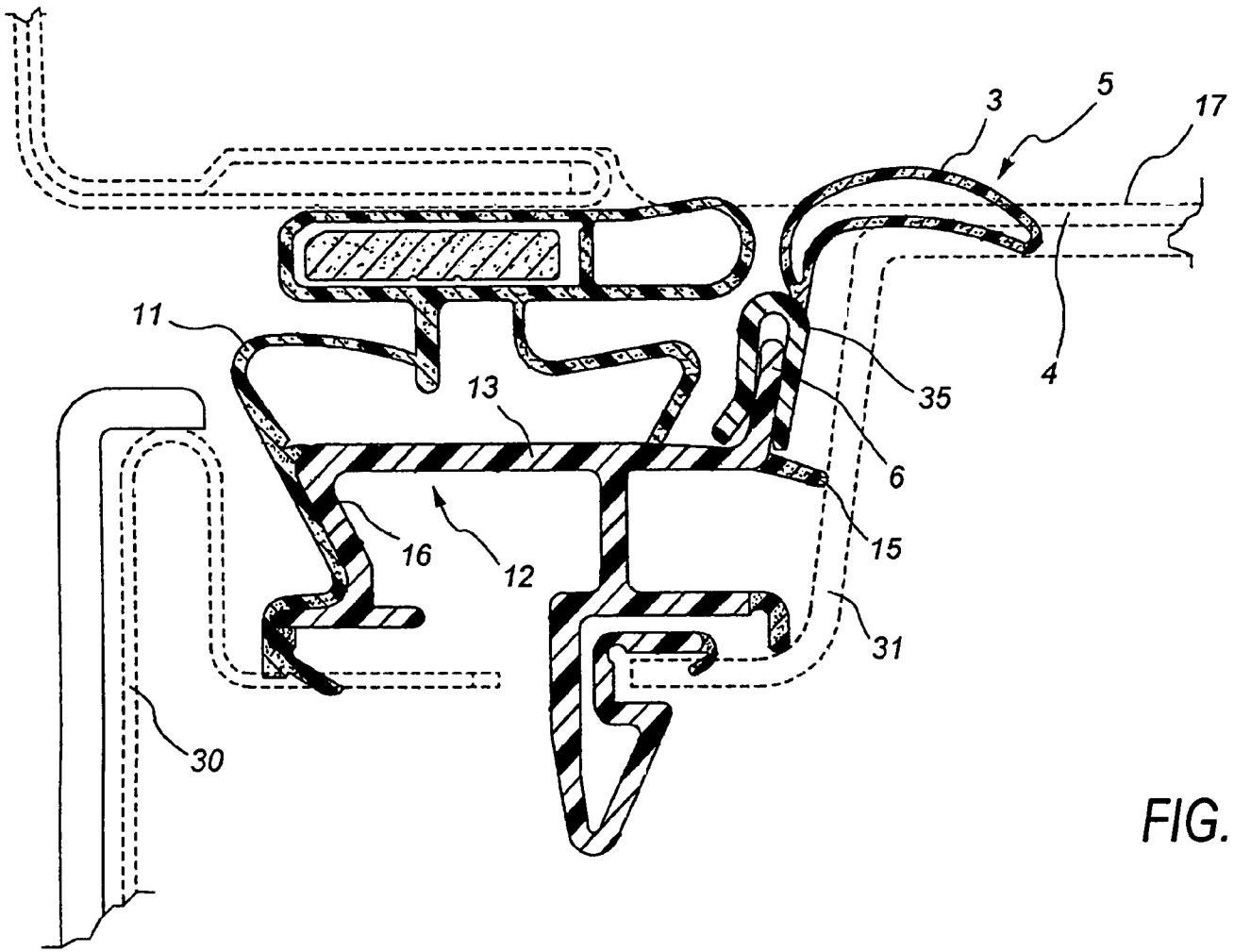

In the embodiment shown in FIG. 4, the sealing means 5 again comprises a tubular chamber, or balloon, 3 with a lengthened section substantially complementary to that of the said space 4 to be sealed—which in this case extends from a securing element 35, preferably made of a U shaped rigid material, capable of mating by interference in conjunction with said section 6 of the rigid base onto which it is fitted.

In the embodiments in FIGS. 2, 3, 4, the soft bellows-type portion 11 is coextruded on one side along the wall 16 with the rigid base portion 12 and on the other side, the one operationally placed towards the inner door, with the horizontal section 13.

Figure 5:
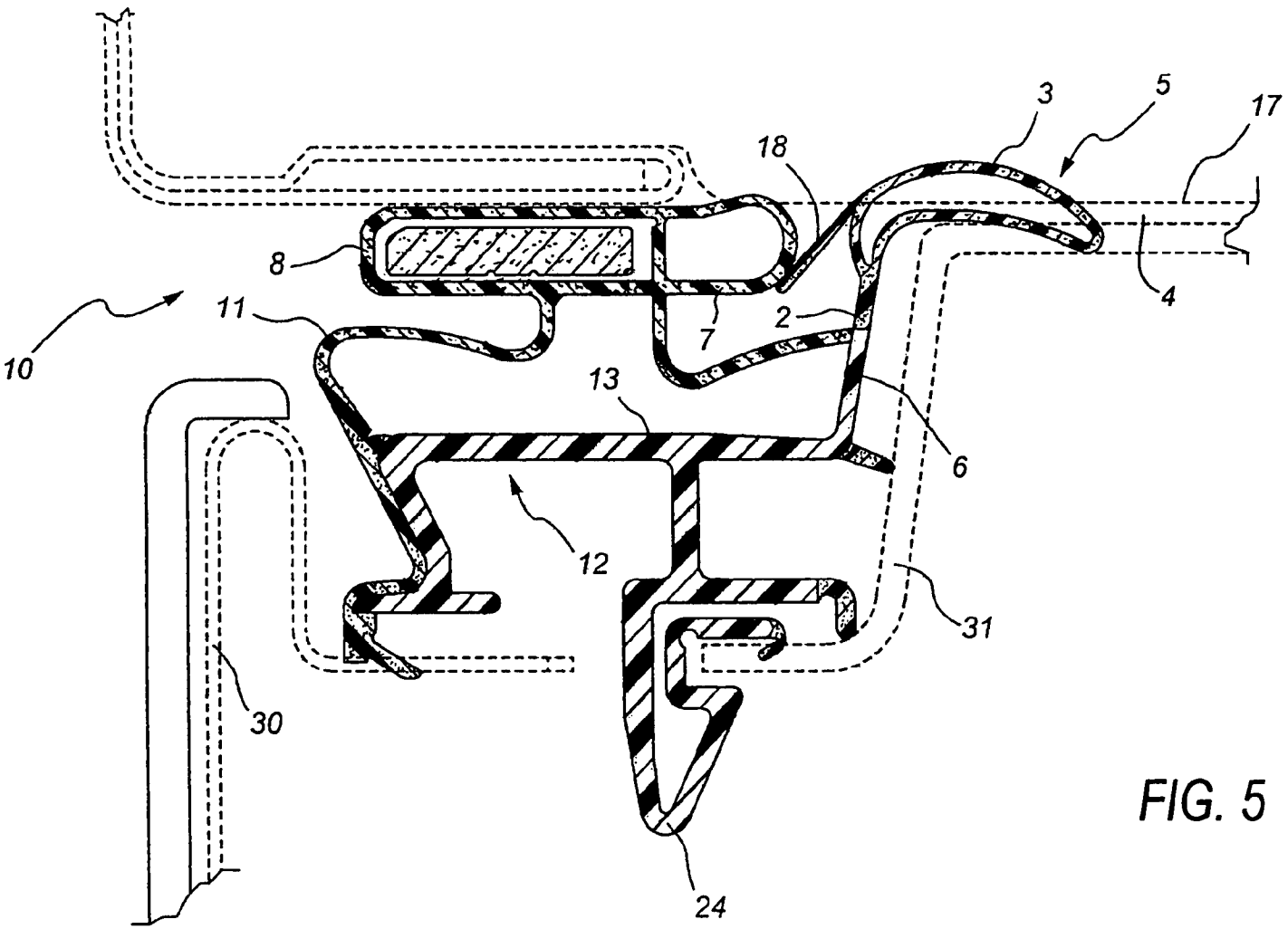

In the embodiment in FIG. 5, the soft bellows-type portion 11 is coextruded with the rigid base portion 12 on one side along the wall 16 and on the other side, the one operationally towards the inner door, with said vertical section 6. In such embodiment, the sealing means 5 again comprises a tubular chamber, or balloon, 3 with a lengthened section substantially complementary to that of the said space 4 to be sealed, and a sealing lip 18 which operationally extends towards the bellows 11.

Figure 6:
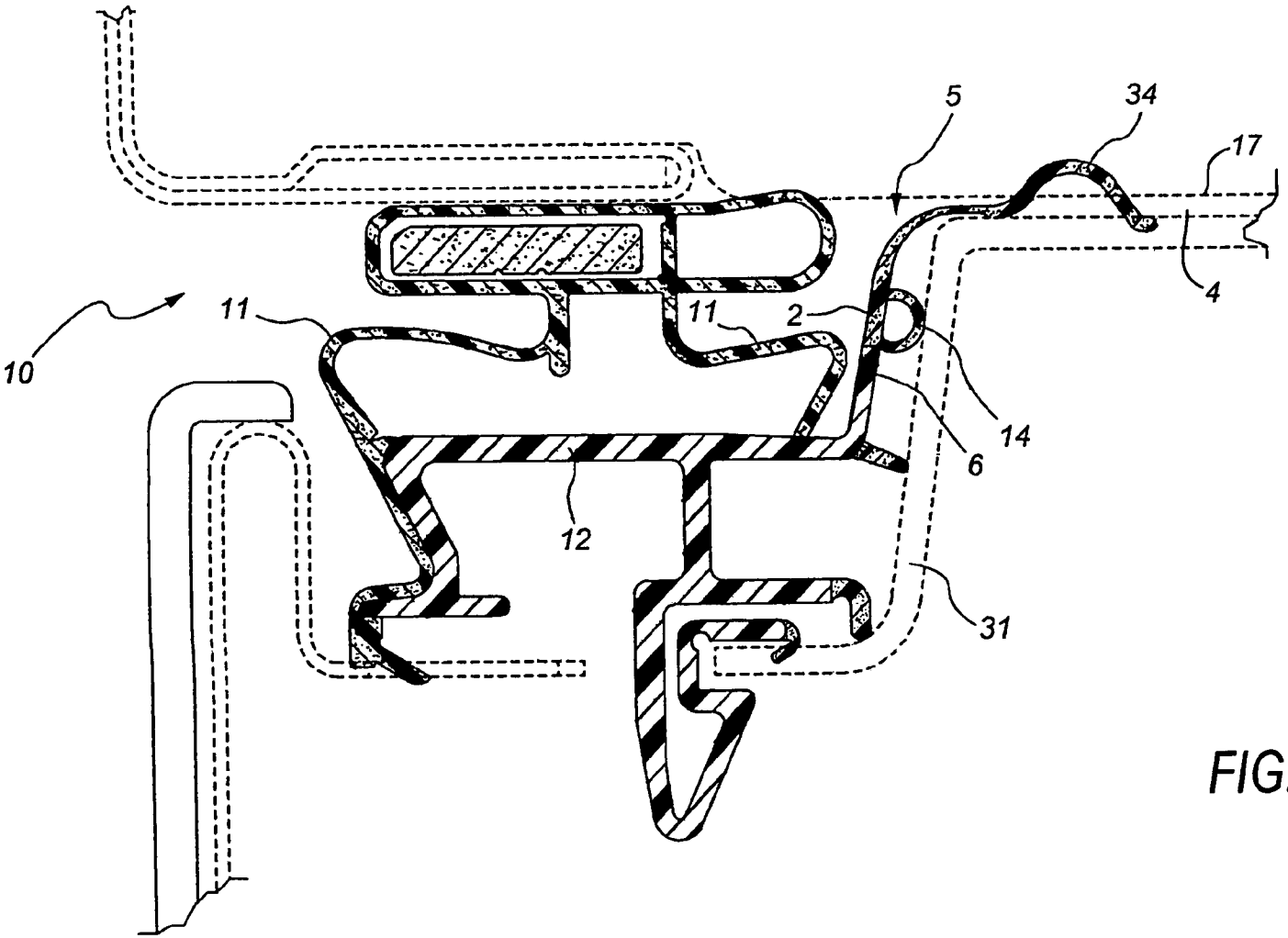

In the embodiment shown in FIG. 6, the sealing means 5 comprises a tubular sealing element 14 which extends from section 2 towards the inner door, said section 2 being reduced to an extended sealing lip 34 with a corrugated section, suitably shaped for sealing the space 4 in the sealing operating position of the door, as shown in the figure.

In the embodiment in FIG. 7, the soft bellows-type portion 11 is coextruded with the rigid base portion 12 on one side along the wall 16 and on the other side, the one operationally towards the inner door, at said vertical section 6. In such embodiment, the sealing means 5 still comprises a tubular chamber, or balloon, 3 with a lengthened section substantially complementary to that of the said space 4 to be sealed, and a sealing lip 18 which operationally extends towards the bellows 11, so as to come into contact with it at the balloon 7, as shown in the figure, due to its deformation after compression.

In the embodiment shown in FIG. 8, the shape of the sealing means 5 is substantially similar to that of the embodiment shown in FIG. 7, said tubular chamber, or balloon, 3 having in this case a larger section than the one in the other embodiments shown, thus coming into contact with the balloon 7 as well, after compression, thereby sealing the entire adjacent space, without a lip 18 as included in the embodiment of FIG. 7.

In the embodiment shown in FIG. 9, the sealing means 5 still comprises a tubular chamber, or balloon, 3 with a lengthened section substantially complementary to that of the said space 4 to be sealed—which reaches out from an extending section 2 of section 6 of the rigid base which substantially follows the profile of the inner door. In this case, said section 6 is not coextruded with section 2 but receives it by interference as it is suitably shaped according to a U-section 6-6' in which section 2 can be firmly fitted by pressing due to, for instance, ribs whereby it is conformed at the surface. Such embodiment makes it possible to match the bellows 11 with a sealing means 5 which may have different heights of section 2 or different forms of the balloon 3, depending on the conformation of the inner door with which the gasket is matched.

In the embodiment shown in FIG. 10, the stiffness required is in this case given to section 6 of the base 12 as well as to the rest of the base thereof because of the thickening of the monoextruded section and not because of the intrinsic features of the plastic material used. The sealing means 5 still comprises a tubular chamber, or balloon, 3 with a lengthened section substantially complementary to that of the said space 4 to be sealed. The thickness of the balloon 3 can be similar to that of the bellows 11, hence such two soft sealing elements have flexibility features, whereas the thickened base 12, including the vertical section 6, also has stiffness features although in a monoextruded section.

In another embodiment, said stiffness features can be given to said base 12 with any equivalent means.

In further embodiments, the various tubular elements or balloons such as 14 can also be made from an expandable material or from internally coextruded foamed material, so as to allow spring back and flexibility features to optimize the sealing.

In further embodiments, said soft section 2 or rigid section 6 can have different heights, depending on the side of the inner door they need to match. The said balloon 3 can also have different forms depending on the side of the inner door it will match; furthermore, it can be welded or fixed to the rest of the gasket with different techniques.

By combining the above-mentioned, or equivalent, elements it is possible to obtain numerous other embodiments by combining the elements in a different way, provided that the fundamental structural feature is maintained according to the present invention, that is having two sealing means made of soft material, hence deformable, supported by the same rigid base, one of which—the sealing means 5—works by compression at low temperatures in a more internal area of the refrigerator and the other—the extendible bellows 11—works by extension (preferably due to the pull achieved through a magnetic profile), said sealing means being made so as to eliminate all mutual interferences, making them structurally and functionally independent, thus simultaneously eliminating the negative cooling effect on the functionality of the portion of magnetic seal, which can thus be obtained with more inexpensive material.

This is obtained because the two sealing means at issue, made of soft material, extend from the same base and are capable of matching the door and inner door of the refrigerator cabinet without direct mutual constraints. In other words, they are independently bound to the same rigid base, and definitely not between each other.

To this end, the sealing lip 18 shown in the embodiments in FIGS. 5 and 7, although it's operating position is against the balloon 7 of the bellows, is independent from the latter because their soft structures are free from mutual constraints.

Therefore, the two soft sealing elements operate and move independently from each other, thereby ensuring a perfect seal on the cabinet under different loading, and hence, positioning conditions in which the refrigerator door operates when using the refrigerator thereof, whereas the base portion in common continues to allow an easy installation of the gasket on the refrigerator door.

Furthermore, such portion of rigid base of the gasket which separates the two soft independent sealing means works as a thermal barrier because it improves the insulation, thereby making the heat transmission more difficult from one zone to another.

If the material of the gasket base is rigid at room temperature, T, such separating section will not mechanically suffer from any progressive cooling effects between the inside and the outside, thereby eliminating any further possibility of interference between the two sealing means.

According to the present invention, said means substantially made of soft material, which seals the space located between said cabinet and the inner door, maintains good flexible and spring back features even when temperatures are lower than 0° C., thus sealing, by compression, a more internal area of the refrigerator with respect to that in which the soft bellows-type portion is located.

Said sealing means 5, or at least its portion 3, can be made from material different from that of said soft bellows-type portion 11, said material of said means 5 having flexible features which allow for easy twisting and good spring back features at the low temperatures commonly used with refrigerators and freezers, selected among those having a glass transition temperature (Tg) lower than the minimum operating temperature of the refrigerator.

In most critical applications, i.e. freezers, the sealing means 5 according to the invention advantageously consists of a material with suitable elastic properties at low temperatures. To improve its spring back features, foamed material inside the balloon 3 may also be considered.

The choice of the most suitable material, capable of maintaining the flexibility features under normal operating conditions, can be made by using the criterion of the glass transition temperature (Tg) of the material thereof, which must always be lower than the minimum operating T of the refrigerator (Tf). The greater the $\Delta T$, the better the elastic performance of the gasket. Preferably, the difference between the Tg and Tf shall be higher than 20° C. Hence the gasket can be achieved by monoextrusion with material suitable for operating at low temperatures, i.e. SEBS or PU, or by coextrusion of two, three or more materials, i.e. PVC and PP for the extendible bellows and the base, and more expensive materials, i.e. PU and SEBS, for the inner sealing means. The choice will be made according to the cost of each single material as well as the conditions of use.

The invention claimed is:

1. A gasket for installation on the door of a refrigerator cabinet having a door made of an outer door and an inner door, comprising a soft bellows portion for sealing the area between the cabinet and the door thereof, extending from a base portion able to match the outer door and/or the inner door of the refrigerator cabinet and provided with securing means to the inner door, characterized in that said base portion is rigid and that at the inner end thereof, positioned to face the inner door, soft sealing means extends to seal an inner space located between the cabinet and inner door in a more internal area of the refrigerator with respect to that in which the soft bellows portion is located, said soft sealing means and said soft bellows portion independently extending from said rigid base portion and being free from constraints one with respect to the other, wherein said rigid base portion includes a horizontal section from which, at the inner end of said horizontal section operationally facing the inner door, a rigid section extends generally upwardly therefrom not contacting the inner door, and generally follows the profile of the inner door towards said inner space, said soft sealing means comprising a closed chamber independent of said rigid base portion and said soft bellows portion, said soft sealing means extending from said rigid section and being capable of contacting in a deformable manner the inner door and the cabinet in said more internal area.

2. The gasket according to claim 1, wherein said soft sealing means extends from said rigid section by interposition of a section coextruded in soft material extending from said rigid section.

3. The gasket according to claim 2, wherein said soft sealing means comprises a section coextruded in soft material capable of mating by interference with said rigid section shaped according to a U-section in which said section coextruded in soft material can be firmly fitted by pressing.

4. The gasket according to claim 2, wherein said soft sealing means further comprises a tubular sealing element which extends from said rigid section towards the inner door.

5. The gasket according to claim 1, wherein said soft sealing means comprises a tubular chamber, or balloon, with a lengthened section substantially complementary to that of said inner space so as to seal such space by deforming through squashing on the edge of the cabinet when the door, and corresponding inner door, is closed.

6. The gasket according to claim 5, wherein said tubular chamber, or balloon, is made from a material different from that of said soft bellows portion, selected among those having a Tg lower than the minimum operating temperature of the refrigerator.

7. The gasket according to claim 1, wherein said soft sealing means extends from a securing means having a U-shape capable of mating by interference in conjunction with said rigid section.

8. The gasket according to claim 1, characterized in that it is made in one soft material, of the type used for said bellows portion, with increased thickness of said base portion.

9. The gasket according to claim 1, wherein said soft sealing means further comprises a sealing lip which operationally extends towards said soft bellows portion.

10. The gasket according to claim 1, wherein in the area in which said rigid base is shaped according to said rigid section, a soft lip is provided as an additional sealing device which operationally extends towards the inner door.

11. The gasket according to claim 1, wherein said soft bellows portion is coextruded with said rigid base portion on one side, and with said horizontal section of said rigid base portion on the side operationally placed towards the inner door.

12. The gasket according to claim 1, wherein said soft bellows portion is coextruded with said rigid base portion on one side, and with said rigid section of said rigid base portion on the side operationally placed towards the inner door.

13. The gasket according to claim 1, wherein said soft sealing means is at least partly made from a material different from that of said soft bellows portion, selected among those having a Tg lower than the minimum operating temperature of the refrigerator.

14. A gasket for installation in a door of a refrigerator cabinet, the door including an outer door and an inner door, said gasket comprising a rigid base portion configured and dimensioned to match at least a portion of the inner door, and having means to secure said rigid base portion to the inner door, said rigid base portion including in cross-section, a horizontal section having a soft bellows portion extending upwardly therefrom toward the refrigerator cabinet for engagement therewith when the door is in a closed position, said horizontal section having at an inner end thereof which operationally faces the inner door, a non-deformable and rigid extension member which extends generally upwardly therefrom not contacting the inner door, said rigid extension member substantially follows the profile of the inner door towards an inner space located between the inner door and the refrigerator cabinet in a more internal area of the refrigerator, said rigid extension member having at the free end thereof, soft sealing means positioned and dimensioned to engage the refrigerator cabinet and the door in a deformable manner in the general location of said inner space when the door is in a closed position, said soft sealing means forming at least one closed chamber independent of said rigid base portion, said soft sealing means and said soft bellows portion being independent and free from constraints one with respect to the other, said rigid extension member not being deformable relative to said soft sealing means.

15. The gasket according to claim 14, wherein said soft sealing means comprises a first soft sealing means capable of contacting the inner door, and a second soft sealing means capable of contacting the inner door and the cabinet in said more internal area when the outer door, and corresponding inner door, is closed.

16. A gasket for installation on the door of a refrigerator cabinet having a door made of an outer door and an inner door, comprising a soft bellows portion for sealing the area between the cabinet and the door thereof, extending from a base portion able to match the outer door and/or the inner door of the refrigerator cabinet and provided with securing means to the inner door, characterized in that said base portion is rigid and that at the inner end thereof, positioned to face the inner door, a soft sealing element extends to seal an inner space located between the cabinet and inner door in a more internal area of the refrigerator with respect to that in which the soft bellows portion is located, said soft sealing element and said soft bellows portion independently extending from said rigid base portion and being free from constraints, one with respect to the other, wherein said rigid base portion includes a horizontal section which, at the inner end of the horizontal section operationally facing the inner door, extends generally upwardly therefrom according to a rigid section which generally follows the profile of the inner door towards said inner space, and is not contacting the inner door, whereby said soft sealing element extends from said rigid section and includes a first soft sealing means capable of contacting the inner door, and a second soft sealing means capable of contacting the inner door and the cabinet in said more internal area.

17. The gasket according to claim 16, wherein said first soft sealing means comprises a tubular sealing element extending from said generally upwardly extending rigid section towards the inner door.

18. The gasket according to claim 17, wherein said second soft sealing means comprises a closed chamber capable of contacting in a deformable manner the inner door and the cabinet in said more internal area.

19. The gasket according to claim 17, wherein said second soft sealing means comprises an extended sealing lip with a corrugated section.

20. The gasket according to claim 16, wherein said second soft sealing means comprises said section coextruded in soft material which is suitably shaped for sealing said inner space by deforming, through squashing, on the edge of the cabinet when the outer door, and corresponding inner door, is closed.

21. A gasket for installation on the door of a refrigerator cabinet having a door made of an outer door and an inner door, comprising a soft bellows portion for sealing the area between the cabinet and the door thereof, extending from a base portion able to match the outer door and/or the inner door of the refrigerator cabinet and provided with securing means to the inner door, characterized in that said base portion is made of a rigid gasket material and that at the inner end thereof, positioned to face the inner door, soft sealing means made of a soft gasket material extends to seal an inner space located between the cabinet and inner door in a more internal area of the refrigerator with respect to that in which the soft bellows portion is located, said soft sealing means and said soft bellows portion independently extending from said rigid base portion and being free from constraints one with respect to the other, wherein said rigid base portion includes a horizontal section from which, at the inner end of said horizontal section operationally facing the inner door, a rigid section extends generally upwardly therefrom and generally follows the profile of the inner door towards said inner space, said soft sealing means comprising a closed chamber independent of said rigid base portion and said soft bellows portion, said soft sealing means extending from said rigid section and being capable of contacting in a deformable manner the inner door and the cabinet in said more internal area.

22. A gasket for installation on the door of a refrigerator cabinet having a door made of an outer door and an inner door, comprising a soft bellows portion for sealing the area between the cabinet and the door thereof, extending from a base portion able to match the outer door and/or the inner door of the refrigerator cabinet and provided with securing means to the inner door, characterized in that said base portion is made of a soft gasket material of thickness sufficient to make it rigid and that at the inner end thereof, positioned to face the inner door, soft sealing means made of a soft gasket material extends to seal an inner space located between the cabinet and inner door in a more internal area of the refrigerator with respect to that in which said soft bellows portion is located, said soft sealing means and said soft bellows portion independently extending from said rigid base portion and being free from constraints one with respect to the other, wherein said rigid base portion includes a horizontal section from which, at the inner end of said horizontal section operationally facing the inner door, a rigid section extends generally upwardly therefrom not contacting the inner door, and generally follows the profile of the inner door towards said inner space, said soft sealing means comprising a closed chamber independent of said rigid base portion and said soft bellows portion, said soft sealing means extending from said rigid section and being capable of contacting in a deformable manner the inner door and the cabinet in said more internal area.

23. The gasket according to claim 22, wherein said rigid section which extends generally upwardly from said horizontal section of said rigid base portion is comprised of a soft gasket material of thickness sufficient to make it rigid.

* * * * *